US007556422B2

(12) United States Patent
Cretin et al.

(10) Patent No.: US 7,556,422 B2
(45) Date of Patent: Jul. 7, 2009

(54) LOCKABLE PUSH-PIECE

(75) Inventors: Christophe Cretin, Bellefontaine (FR); Laurent Morel, Bellefontaine (FR)

(73) Assignee: Richemont International S.A., Villars-sur-Glane (CH)

( * ) Notice: Subject to any disclaimer, the term of this patent is extended or adjusted under 35 U.S.C. 154(b) by 0 days.

(21) Appl. No.: 11/885,543

(22) PCT Filed: Feb. 7, 2006

(86) PCT No.: PCT/IB2006/000295

§ 371 (c)(1),
(2), (4) Date: Jul. 21, 2008

(87) PCT Pub. No.: WO2006/092684

PCT Pub. Date: Sep. 8, 2006

(65) Prior Publication Data

US 2008/0285390 A1 Nov. 20, 2008

(30) Foreign Application Priority Data

Mar. 1, 2005 (CH) ..... 0355/05

(51) Int. Cl.
*G04B 37/00* (2006.01)
*G04B 29/00* (2006.01)

(52) U.S. Cl. ..... 368/290; 368/308; 368/319

(58) Field of Classification Search ..... 368/288–290, 368/308, 319–321
See application file for complete search history.

(56) References Cited

U.S. PATENT DOCUMENTS

| | | | | | |
|---|---|---|---|---|---|
| 1,292,446 | A | | 1/1919 | Dunham | |
| 1,295,023 | A | | 2/1919 | Golden | |
| 2,482,317 | A | * | 9/1949 | Borer | 368/288 |
| 3,362,154 | A | * | 1/1968 | Perret | 368/290 |
| 4,292,682 | A | * | 9/1981 | Wenger | 368/289 |
| 5,383,166 | A | * | 1/1995 | Gallay | 368/288 |
| 6,137,750 | A | * | 10/2000 | Rieben | 368/290 |
| 6,200,020 | B1 | * | 3/2001 | Rieben | 368/290 |
| 6,447,159 | B1 | * | 9/2002 | Damasko | 368/308 |
| 6,902,169 | B2 | | 6/2005 | Wild | |

FOREIGN PATENT DOCUMENTS

| | | |
|---|---|---|
| CH | 350249 | 12/1960 |
| CH | 675809G A3 | 11/1990 |
| EP | 0 400 207 A1 | 12/1990 |
| EP | 1 280 023 A1 | 1/2003 |
| EP | 1 376 270 A1 | 1/2004 |
| FR | 1 471 802 | 3/1967 |

* cited by examiner

*Primary Examiner*—Vit W Miska
(74) *Attorney, Agent, or Firm*—Young & Thompson

(57) ABSTRACT

A push-actuated control device for watches includes a push-piece button (1) connected with a push-piece shaft (2) passing through a push-piece pipe (3) intended to be accommodated in the watchcase. The device further includes a compression ring (4) screwed onto the push-piece pipe (3) and a compression gasket (5) placed between pipe (3) and ring (4), the gasket (5) being compressed while ring (4) is in a screwed first position. Compression ring (4) on a segment of its inner circumference includes a twofold axial stop (4.1, 4.2), and push-piece button (1) includes a projection (1.1) on its outer circumference, so that compression ring (4) cooperates with push-piece button (1) to block the push-piece button (1) in its first position, and liberate it in an unscrewed second position.

14 Claims, 3 Drawing Sheets

LOCKABLE PUSH-PIECE

Figure 1A:
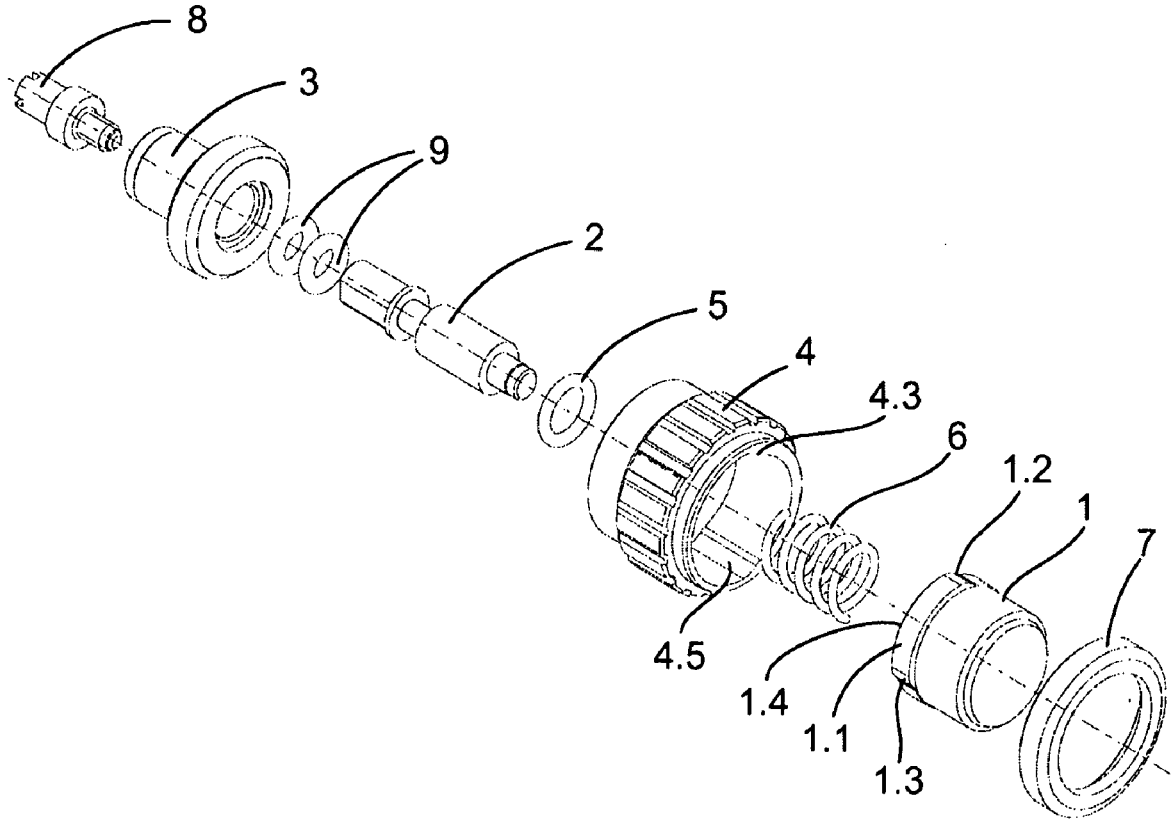

The present invention concerns a push-actuated control device for watches comprising a push-piece button connected with a push-piece shaft passing through a push-piece pipe accommodated in the watchcase, the device further comprising a compression ring screwed onto the push-piece pipe and a compression gasket placed between the pipe and the ring, the gasket being compressed while the ring is in a screwed first position.

Conventional devices of this kind make it possible to raise the water tightness of the watch by including an additional gasket arranged in the space between the compression ring, the pipe, and the shaft. This gasket is compressed between the ring and the pipe while the compression ring is screwed onto the pipe, and its inner side face thus is pushed against the shaft of the push-piece button, hence raising the water tightness between these two parts.

The pressure applied by the gasket that is compressed against the shaft is at the same time often used in these devices to block the push-piece button or a crown against being actuated. Screwing the compression ring then will reinforce the water tightness of the device and at the same time block the shaft or push-piece button. This leads to certain disadvantages. It is obvious at first that with such an arrangement one cannot separate the means that are used for the different functions, that is, enhanced water tightness and blocking of the push-piece. Moreover, the blocking force depends on the axial displacement of the ring that is produced by its rotation during screwing, so that a rather important angular displacement of the compression ring is needed for the axial movement of the shaft to be efficiently blocked or liberated. Also, the gasket is liable to be damaged by application of an overly large force exerted on the push-piece button in the blocked position.

It is the aim of the present invention to remedy the disadvantages of the current systems that have been cited above, and to yield a device of the kind mentioned above that is simple and fast in its use, needs no important angular screwing, and has a blocking force that is independent of the angular displacement of the ring.

To this end, the object of the present invention is a push-actuated control device having the characteristics listed in claim 1.

This control device more particularly comprises a compression ring having on a segment of its inner circumference a twofold axial stop and a push-piece button with a projection on its outer circumference so designed that the compression ring will cooperate with the push-piece button to block the push-piece button in a screwed first position of the compression ring, and to liberate it in an unscrewed second position.

The means for raising the water tightness of the device and for blocking the push-piece button thus are separated. A minor angular displacement will suffice for locking the push-piece, the locking force moreover being independent of this displacement. Damage to the compression gasket produced by forced actuation of the push-piece button is excluded, and the use is simple and fast, because the device needs no major screwing.

Further advantages will become apparent from the characteristics expressed in the dependent claims and from the description presenting hereafter the invention in more detail with the aid of drawings.

The annexed drawings represent by way of example an embodiment of the invention.

Figure 1B:
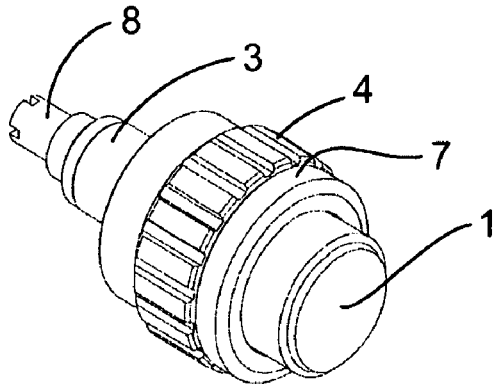

FIG. 1*a* is an exploded view of the control device according to the present invention; FIG. 1*b* is a perspective view of the assembled device.

Figure 2A:
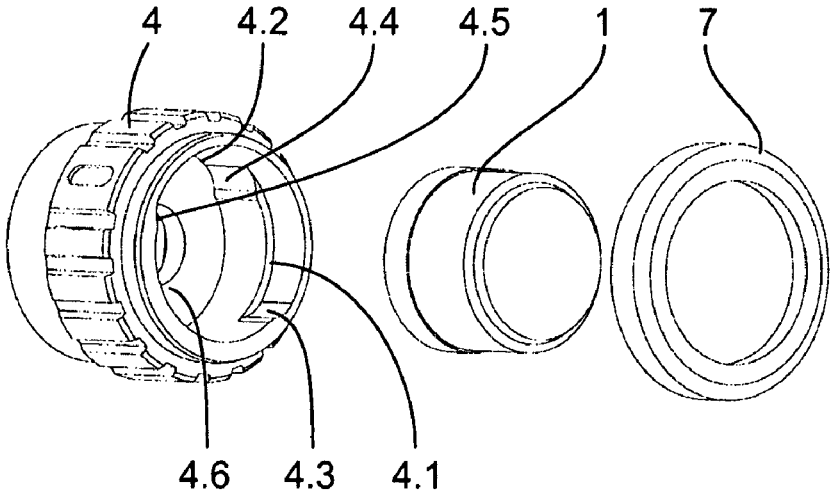
Figure 2B:
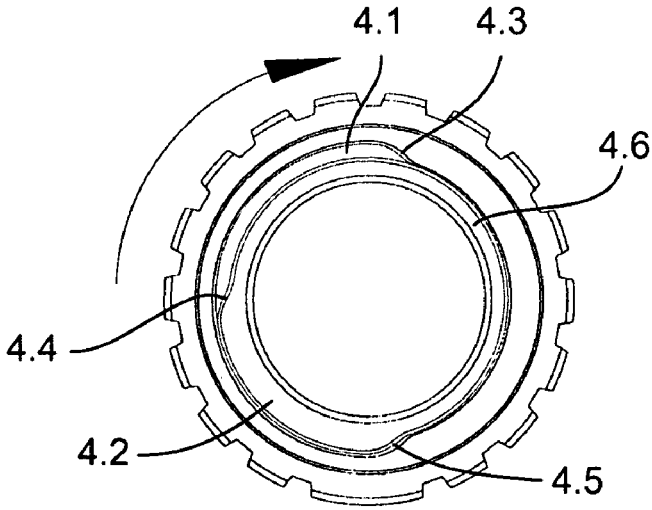
Figure 2C:
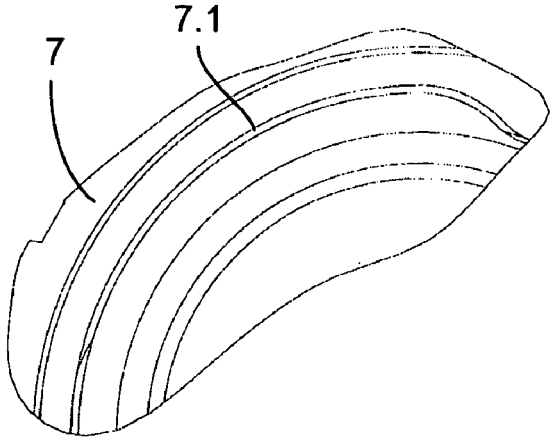

FIG. 2*a* is an exploded view of the compression ring with the push-piece button and the cover also showing the axial and angular stops of the ring; FIG. 2*b* is a top view of the compression ring illustrating more particularly the angular stops; FIG. 2*c* is a partial view of the cover illustrating the groove serving as dust trap.

Figure 3A:
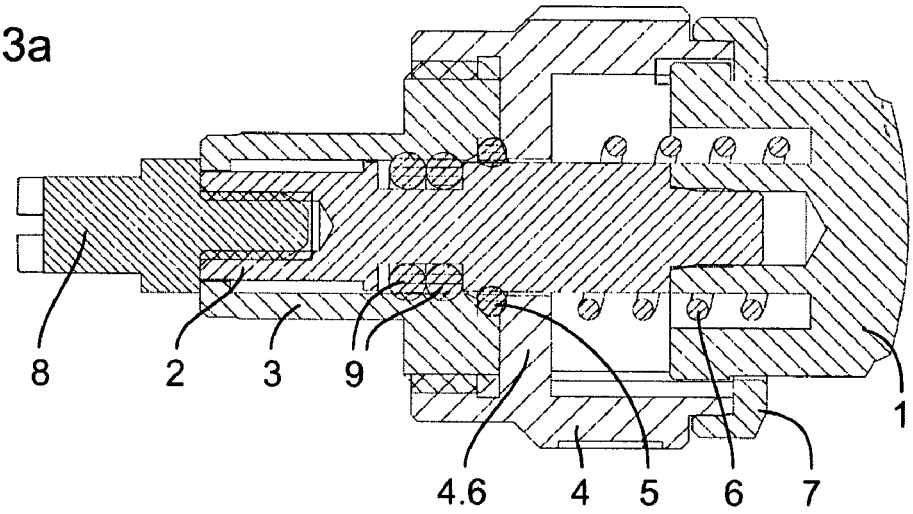
Figure 3B:
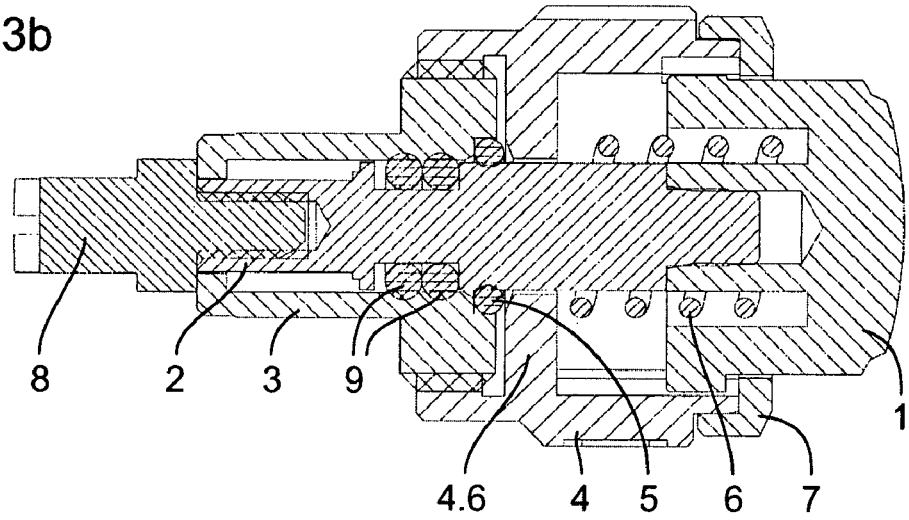
Figure 3C:
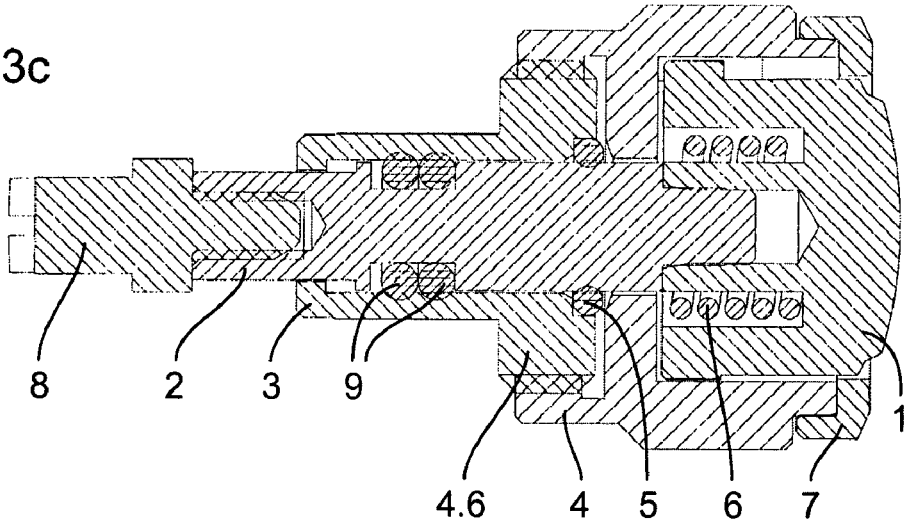

FIGS. 3*a*, 3*b*, and 3*c* represent the device in its blocked, unblocked, and actuated positions.

The invention will now be described in detail while referring to the annexed drawings illustrating by way of example an embodiment of the invention.

Referring to FIGS. 1*a* and 1*b*, one can readily explain the different parts of the device as well as their assembly. The device includes first of all a push-piece button 1 connected with a push-piece shaft 2 passing through a push-piece pipe 3 that is supposed to be accommodated in the case of a watch. The push-piece button 1 with its shaft 2 is mounted with conventional means onto the middle in nonrotating fashion. The push-piece shaft 2 is equipped with at least one gasket 9 in order to secure base-level water tightness between this shaft 2 and the pipe 3. Towards its inner end this shaft 2 is fastened to a screw 8 of the push-piece, for instance by screwing, in order to enable the cooperation between the control device and the parts in the interior of the watchcase, and thus the control of whatever function of the watch or its movement.

The device also comprises a compression ring 4 screwed onto the push-piece pipe 3, as well as a compression gasket 5 placed between pipe 3 and ring 4. The compression ring 4 can be seen as a hollow cylinder with an annular wall 4.6 across it toward the centre, thus forming two pot-shaped compartments, one oriented toward the interior of the watch and the other toward the outside. The annular wall 4.6 has an opening in its centre through which the push-piece shaft 2 passes. The compartment turned toward the interior has a thread, preferably left-handed, on its inner cylinder surface in order to allow ring 4 to be screwed onto the pipe 3 that is provided with a corresponding thread on its outside. The compression gasket 5 is compressed when ring 4 is in a first position in which it is screwed onto pipe 3, thus reinforcing the level of water tightness of the device. The compartment turned toward the outside serves to accommodate a helical spring 6 placed between the annular wall 4.6 of compression ring 4 and the push-piece button 1, so as to exert an outward bias on push-piece button 1, and to also accommodate at least in part the push-piece button 1.

Once the push-piece button 1 and spring 6 are in place on compression ring 4, a cover 7 is attached to compression ring 4, for example driven or glued. With this cover 7 one can limit the longitudinal motion of the group of push-piece shaft 2 and push-piece button 1 toward the outside, by making its inner diameter smaller than the outer diameter of the push-piece button 1 that is surrounded by it. Cover 7 moreover has at least one circular groove 7.1 on its outside that serves as a dust trap so as to protect the interior of the watch and device against dust intrusion, as represented in FIG. 2*c*.

Compression ring 4 has a twofold axial stop 4.1, 4.2 as well as a twofold angular stop 4.3, 4.4 on part of its inner circumference, both stops having a peculiar geometric shape. To this end the compartment of compression ring 4 that is oriented toward the outside has a diameter smaller than the rest of the compartment, over a first angular segment of its inner circumference, for instance over 270°, and over part of its axial extension, as over the first half of this compartment next to the annular wall 4.6, as shown in FIG. 2*a*. The same smaller diameter is present in a second angular segment of the inner circumference that stretches over a smaller angle than the first segment, for example a segment of 180° of the circumference, and is axially located in the second half of the compartment that is oriented toward the outside, the initial angular stop 4.5 of this segment being aligned with that of the first segment, while those segments of the inner circumference that have a larger diameter form a clearance with two axial levels. The inner circumference of this compartment of ring 4 thus has a first axial stop 4.1 situated between the first and second angular segments with smaller diameter. A second axial stop 4.2 is formed by the outside of the annular wall 4.6 that is not covered by the first angular segment of smaller diameter of the inner circumference.

The ends of the first and second angular segments of smaller diameter that are opposite to their initial angular stop 4.5 form a first angular stop 4.3 and a second angular stop 4.4 on compression ring 4, as shown schematically in FIG. 2*b*.

The push-piece button 1 generally has an outer diameter slightly smaller than the diameter of said first and second angular segments of the inner circumference of ring 4. In addition it has a projection 1.1 on its outer circumference, as illustrated in FIG. 1*a*. Preferably, this projection 1.1 corresponds to the geometric shape of the clearance left by said angular segments on the inner circumference of the compartment of compression ring 4 that is oriented toward the outside. In the example presented above, projection 1.1 has an angular extension of 90°, for example, but this choice, just like the choice made for the axial and angular extent of the first and second angular segments of smaller diameter on the inner circumference of ring 4, evidently is liable to be modified, and merely represents a particular embodiment for a device according to the invention. It will suffice in general when the angular extent of projection 1.1 is smaller than the angle of the clearance left by the first angular segment of the inner circumference of compression ring 4.

Compression ring 4 cooperates with push-piece button 1 to lock the push-piece button 1 in its screwed first position and liberate it in a second position in which ring 4 is unscrewed. In the screwed first position of compression ring 4 an axial stop 1.4 present on projection 1.1 of push-piece button 1 leans against the first axial stop 4.1 of ring 4. At the same time, a first angular stop 1.2 on the projection in this position normally is aligned with the first angular stop 4.3 of ring 4, but blocking of push-piece button 1 against its being actuated is effective with a constant blocking force in all angular positions where the first angular stop 1.2 of projection 1.1 is found between the first angular stop 4.3 and second angular stop 4.4 of ring 4. The blocking position is illustrated in cross section in FIG. 3*a* showing, on the one hand that push-piece button 1 cannot be actuated while projection 1.1 directly faces the first axial stop 4.1 of ring 4, and on the other hand that compression gasket 5 is compressed so as to yield enhanced water tightness.

After unscrewing of compression ring 4, in the example presented above by turning ring 4 by 90° toward the right, the first angular stop 1.2 of projection 1.1 is aligned with the second angular stop 4.4 of ring 4. A second angular stop 1.3 on projection 1.1 of push-piece button 1 leans against the initial angular stop 4.5 of ring 4. In this position, represented in FIG. 3*b*, the axial stop 1.4 of projection 1.1 of push-piece button 1 is liberated, and the push-piece thus is unlocked. In addition, compression gasket 5 is no longer compressed, while water tightness of the device is secured by one or several gaskets 9.

FIG. 3*c* finally shows the position of the device in which push-piece button 1 is unblocked and actuated. On account of corresponding geometric shapes of projection 1.1 and the inner circumference of ring 4, the initial angular stop 4.5 and/or the second angular stop 4.4 of ring 4 can serve as guiding elements for the longitudinal motion of push-piece button 1 while cooperating with the first angular stop 1.2 and second angular stop 1.3 of its projection 1.1.

Compression ring 4 when screwed onto the push-piece pipe 3 then serves to lock push-piece button 1 so as to inhibit its unintentional actuation, and to secure water tightness between pipe 3 and push-piece shaft 2. Contrary to known devices, ring 4 includes different means for different functions, more particularly a thread for producing an axial displacement that is sufficiently large to compress the additional gasket 5, and a twofold axial stop having a geometric shape such as to make it possible that a relatively small angular displacement will suffice for blocking of push-piece button 1. It is achieved by these provisions that the instant device will not require an important angular displacement of compression ring 4, inasmuch as in view of the geometric shape of compression ring 4, locking of push-piece button 1 is achieved, not by an axial displacement produced by the angular displacement but directly by the latter displacement. The blocking force moreover does not depend on the angular displacement of compression ring 4 but is constant, once ring 4 has entered the blocking position. It follows that using a device according to the present invention is simple and faster than using conventional devices.

Patentansprüche

1. Push-actuated control device for watches comprising a push-piece button (1) connected with a push-piece shaft (2) passing through a push-piece pipe (3) accommodated in the watchcase, the device further comprising a compression ring (4) screwed onto the push-piece pipe (3) and a compression gasket (5) placed between pipe (3) and ring (4), the gasket (5) being compressed while ring (4) is in a screwed first position, characterised in that compression ring (4) on a segment of its inner circumference includes a twofold axial stop (4.1, 4.2), and that push-piece button (1) includes a projection (1.1) on its outer circumference, such that compression ring (4) cooperates with push-piece button (1) to block the push-piece button (1) in its first position, and liberate it in an unscrewed second position.
2. Control device according to the preceding claim, characterised in that compression ring (4) has the shape of a hollow cylinder with an annular wall (4.6) toward its centre, thus forming two perceptibly pot-shaped compartments, one oriented toward the interior of the watch and the other oriented toward the outside.
3. Control device according to one of the preceding claims, characterised in that compression ring (4) comprises a perceptibly pot-shaped compartment oriented toward the outside that serves to accommodate at least in part the push-piece button (1) and a helical spring (6) placed between compression ring (4) and push-piece button (1) to exert an outward bias on push-piece button (1).
4. Control device according to one of the preceding claims, characterised in that compression ring (4) comprises a perceptibly pot-shaped compartment oriented toward the outside, the inner circumference of this compartment comprising a first angular segment having a smaller diameter than the rest of the compartment, and a second angular segment having a smaller diameter and stretching over a smaller angle than the first angular segment, these two segments being located axially adjacent so as to form a twofold axial stop (4.1, 4.2) of compression ring (4).

5. Control device according to the preceding claim, characterised in that the first angular segment of the inner circumference of compression ring (4) that has a smaller diameter extends over an angle of 270°, and extends axially over the first half of said compartment next to the annular wall (4.6), and that the second angular segment of the inner circumference that has a smaller diameter extends over an angle of 180°, and extends axially over the second half of said compartment, its initial angular stop (4.5) being aligned with that of the first segment, so that the segments of the inner circumference that have a larger diameter form a clearance on two axial levels.
6. Control device according to the preceding claim, characterised in that projection (1.1) extends over an angle of 90° on the outer circumference of push-piece button (1).
7. Control device according to one of preceding claims 5 or 6, characterised in that the ends of the first and second angular segments of smaller diameter that are opposite to their initial angular stop (4.5) form a first angular stop (4.3) and a second angular stop (4.4) on compression ring (4).
8. Control device according to the preceding claim, characterised in that projection (1.1) of push-piece button (1) has a first angular stop (1.2) and a second angular stop (1.3) adapted to cooperate with the first angular stop (4.3) and the second angular stop (4.4) on compression ring (4).
9. Watch, characterised in that it comprises a control device according to one of the preceding claims.

SUMMARY

The present invention concerns a push-actuated control device for watches comprising a push-piece button (1) connected with a push-piece shaft (2) passing through a push-piece pipe (3) intended to be accommodated in the watchcase. The device further comprises a compression ring (4) screwed onto the push-piece pipe (3) and a compression gasket (5) placed between pipe (3) and ring (4), the gasket (5) being compressed while ring (4) is in a screwed first position. Compression ring (4) on a segment of its inner circumference includes a twofold axial stop (4.1, 4.2), and push-piece button (1) includes a projection (1.1) on its outer circumference, so that compression ring (4) cooperates with push-piece button (1) to block the push-piece button (1) in its first position, and liberate it in an unscrewed second position.

The invention claimed is:

1. Push-actuated control device for watches comprising a push-piece button (1) connected with a push-piece shaft (2) passing through a push-piece pipe (3) accommodated in the watchcase, the device further comprising a compression ring (4) screwed onto the push-piece pipe (3) and a compression gasket (5) placed between pipe (3)and ring (4), the gasket (5) being comprised while ring (4) is in a screwed first position, characterised in that compression ring (4) on a segment of its inner circumference includes a twofold axial stop (4.1, 4.2), and that push-piece button (1) includes a projection (1.1) on its outer circumference, such that compression ring (4) cooperates with push-piece button (1) to block the push-piece button (1) in its first position, and liberate it in an unscrewed second position.

2. Control device according to claim 1, characterised in that compression ring (4) has the shape of a hollow cylinder with an annular wall (4.6) toward its centre, thus forming two perceptibly pot-shaped compartments, one oriented toward the interior of the watch and the other oriented toward the outside.

3. Control device according to claim 1, characterised in that compression ring (4) comprises a perceptibly pot-shaped compartment orientated toward the outside that serves to accommodate at least in part the push-piece button (1) and a helical spring (6) placed between compression ring (4) and push-piece button (1) to exert an outward bias on push-piece button (1).

4. Control device according to claim 1, characterised in that compression ring (4) comprises a perceptibly pot-shaped compartment oriented toward the outside, the inner circumference of this compartment comprising a first angular segment having a smaller diameter than the rest of the compartment, and a second angular segment having a smaller diameter and stretching over a smaller angle than the first angular segment, these two segments being located axially adjacent so as to form a twofold axial stop (4.1, 4.2) of compression ring (4).

5. Control device according to claim 4, characterised in that the first angular segment of the inner circumference of the compression ring (4) that has a smaller diameter extends over an angle of 270°, and extends axially over the first half of said compartment next to the annular wall (4.6), and that the second angular segment of the inner circumference that has a smaller diameter extends over an angle of 180°, and extends axially over the second half of said compartment, its initial angular stop (4.5) being aligned with that of the first segment, so that the segments of the inner circumference that have a larger diameter form a clearance on two axial levels.

6. Control device according to claim 5, characterised in that projection (1.1) extends over an angle of 90° on the outer circumference of push-piece button (1).

7. Control device according to claim 5, characterised in that the ends of the first and second angular segments of smaller diameter that are opposite to their initial angular stop (4.5) form a first angular stop (4.3) and a second angular stop (4.4) on compression ring (4).

8. Control device according to claim 7, characterised in that projection (1.1) of the push-piece button (1) has a first angular stop (1.2) and a second angular stop (1.3) adapted to cooperate with the first angular stop (4.3) and the second angular stop (4.4) on compression ring (4).

9. Watch, characterised in that it comprises a control device according to claim 1.

10. Control device according to claim 2, characterised in that compression ring (4) comprises a perceptibly pot-shaped compartment orientated toward the outside that serves to accommodate at least in part the push-piece button (1) and a helical spring (6) placed between compression ring (4) and push-piece button (1) to exert an outward bias on push-piece button (1).

11. Control device according to claim 2, characterised in that compression ring (4) comprises a perceptibly pot-shaped compartment oriented toward the outside, the inner circumference of this compartment comprising a first angular segment having a smaller diameter than the rest of the compartment, and a second angular segment having a smaller diameter and stretching over a smaller angle than the first angular segment, these two segments being located axially adjacent so as to form a twofold axial stop (4.1, 4.2) of compression ring (4).

12. Control device according to claim 3, characterised in that compression ring (4) comprises a perceptibly pot-shaped compartment oriented toward the outside, the inner circumference of this compartment comprising a first angular segment having a smaller diameter than the rest of the compartment, and a second angular segment having a smaller diameter and stretching over a smaller angle than the first angular segment, these two segments being located axially adjacent so as to form a twofold axial stop (4.1, 4.2) of compression ring (4).

13. Control device according to claim 6, characterised in that the ends of the first and second angular segments of smaller diameter that are opposite to their initial angular stop (4.5) form a first angular stop (4.3) and a second angular stop (4.4) on compression ring (4).

14. Control device according to claim 13, characterised in that projection (1.1) of the push-piece button (1) has a first angular stop (1.2) and a second angular stop (1.3) adapted to cooperate with the first angular stop (4.3) and the second angular stop (4.4) on compression ring (4).

* * * * *